United States Patent [19]

Kato et al.

[11] Patent Number: 4,474,610

[45] Date of Patent: Oct. 2, 1984

[54] BUS BAR ARRANGEMENT OF ELECTROLYTIC CELLS FOR PRODUCING ALUMINUM

[75] Inventors: Shozo Kato; Yasuhiko Ujimoto, both of Nagoya, Japan

[73] Assignee: Sumitomo Aluminium Smelting Company, Limited, Osaka, Japan

[21] Appl. No.: 487,691

[22] Filed: Apr. 22, 1983

[30] Foreign Application Priority Data

Apr. 30, 1982 [JP] Japan ..... 57-74171

[51] Int. Cl.[3] ..... C25C 3/08; C25C 3/16

[52] U.S. Cl. ..... 204/243 M; 204/244

[58] Field of Search ..... 204/67, 243 R, 243 M, 204/244–247

[56] References Cited

U.S. PATENT DOCUMENTS

| | | | |
|---|---|---|---|
| 3,415,724 | 12/1968 | Heaton et al. | 204/67 |
| 3,617,454 | 11/1971 | Johnson | 204/67 |
| 3,969,213 | 7/1976 | Yamamoto et al. | 204/243 M X |
| 4,049,528 | 9/1977 | Morel et al. | 204/243 M |
| 4,169,034 | 9/1979 | Morel et al. | 204/244 X |
| 4,250,012 | 2/1981 | Kaluzhsky et al. | 204/243 M |
| 4,270,993 | 6/1981 | Arita | 204/67 |
| 4,313,811 | 2/1982 | Blanc | 204/243 M |
| 4,396,483 | 8/1983 | Schmidt-Hatting | 204/243 M |
| 4,397,728 | 8/1983 | Pfister et al. | 204/243 M |
| 4,431,492 | 2/1984 | Arita et al. | 204/243 M X |

FOREIGN PATENT DOCUMENTS

| | | | |
|---|---|---|---|
| 47-39445 | 10/1972 | Japan | 204/243 M |
| 52-16843 | 5/1977 | Japan | 204/243 M |
| 57-3751 | 1/1982 | Japan | 204/243 M |
| 57-10190 | 2/1982 | Japan | 204/243 M |

*Primary Examiner*—Donald R. Valentine

*Attorney, Agent, or Firm*—Stevens, Davis, Miller & Mosher

[57] ABSTRACT

In electrolytic cells for producing aluminum in a side-by-side arrangement, a number of cathode bus bars connected to cathode current collector bars projected from upstream long side of each electrolytic cell are connected to at least one rising bus bars provided at upstream long side of an adjacent electrolytic cell provided on downstream side through at least one cathode bus bars provided in the space below the relevant cell and in parallel to the axial line of a row of electrolytic cells; the remaining number thereof are connected to rising bus bars provided at short ends of the adjacent electrolytic cell on the downstream side through cathode bus bars extending along outsides at the short ends of the relevant electrolytic cell, a number of cathode bus bars connected to cathode current collector bars projected from downstream long side of each electrolytic cell are connected to at least one rising bus bar provided on upstream long side of the adjacent electrolytic cell on the downstream side, and the remaining number thereof are connected to rising bus bars provided at the short ends of the adjacent electrolytic cell on the downstream side through cathode bus bars extending along outsides at the short ends of the adjacent electrolytic cell on the downstream side. Occurrence of circulating flow phenomena in molten aluminum layer in the cells can be suppressed to improve the current efficiency in the production of aluminum.

5 Claims, 4 Drawing Figures

BUS BAR ARRANGEMENT OF ELECTROLYTIC CELLS FOR PRODUCING ALUMINUM

This invention relates to an electrolytic cell for producing aluminum and particularly to a bus bar arrangement in the electrolytic cells, and more particularly to an improvement in bus bar arrangement in electrolytic cells as disposed in the so-called side-by-side arrangement. The electrolytic cell for producing aluminum will be hereinafter referred to as merely "electrolytic cell".

The electrolytic cell is in a crucible form structure with steel frames, whose insides are lined with refractory bricks, and further thereon with calcined carbon blocks and a carbonaceous stamping mass. An electrolyte bath containing cryolite as the main component is held in the electrolytic cell and kept in a molten state by electric heat generation. Steel cathode current collector bars are embedded in the carbon lining at the bottom of the electrolytic cell and the carbon lining itself serves as a cathode.

Carbonaceous anodes are suspended over the cathode and the bottom end of the anode is dipped in the electrolyte bath. Electrolysis is carried out by passing direct current from the anode to the cathode through the electrolyte bath, and aluminum deposits in a molten state on the cathode surface from the alumina in the electrolyte bath. At the same time, the necessary amount of heat is generated for melting the electrolyte bath.

It is a recent general tendency to utilize electrolytic cells of larger capacity, and such tendency becomes more and more pronounced owing to intensified energy saving and use of automation. On the other hand, with the increasing capacity of the electrolytic cell a vigorous circulation flow phenomenon appears in the molten aluminum layer due to electromagnetic forces, with the result that the molten aluminum layer is heaved up or waves are generated at the boundary surface between the molten aluminum layer and the electrolyte bath. Consequently, the current efficiency of the electrolytic cell is lowered considerably, or the lining of the electrolytic cell is deteriorated, causing various adverse effects, such as early shut-down of the electrolytic cell.

To reduce such an influence of electromagnetic forces, various bus bar arrangements have been proposed for electrolytic cells disposed in the so-called end-to-end arrangement and also in the so-called side-by-side arrangement. The electromagnetic force is an interaction between an electric current and a magnetic field. Particularly magnetic fields generated by the electric current flowing through the cathode bus bars and the anode bus bars have a considerable influence. Thus, the adverse effects of the electromagnetic forces seem to be prevented by appropriate arrangement of cathode bus bars and anode bus bars.

The electrolytic cells disposed in the end-to-end arrangement are not the object of the present invention, and thus will not be described herein. The electromagnetic forces generated in the electrolytic cells disposed in the side-by-side arrangement will be specifically described below.

The side-by-side arrangement of electrolytic cells means that the long sides of the individual electrolytic cells are disposed perpendicular to the current flow direction in a row of electrolytic cells where the ends of the cathode current collector bars are projected from two sides of each electrolytic cell, that is, from upstream side and downstream side of each electrolytic cell with respect to the current flow direction. The former is called upstream side, and the latter downstream side. The electrolytic cells are connected to one another in series, and the upstream side and downstream side of cathode current collector bars of each electrolytic cell on the upstream side are connected to anode bus bars of adjacent electrolytic cell disposed on the downstream side of the former electrolytic cell through the cathode bus bars and rising bus bars.

Electromagnetic forces acting upon the molten aluminum in an electrolytic cell are given by the following equation:

$$FxM = -Dzm \cdot By + DyM \cdot Bz \quad (1)$$

$$FyM = DzM \cdot Bx - DxM \cdot Bz \quad (2)$$

$$FzM = DxM \cdot By - DyM \cdot Bx \quad (3)$$

wherein

FxM: electromagnetic force through molten aluminum in the long side direction of electrolytic cell (as will be hereinafter referred to as "direction x")

FyM: electromagnetic force through molten aluminum in the short end direction of electrolytic cell (as will be hereinafter referred to as "direction y")

FzM: electromagnetic force through molten aluminum in the vertical direction of electrolytic cell (as will be hereinafter referred to as "direction z").

DxM: current density through molten aluminum in direction x.

DyM: current density through molten aluminum in direction y.

DzM: current density through molten aluminum in direction z.

Bx: magnetic flux density in direction x.

By: magnetic flux density in direction y.

Bz: magnetic flux density in direction z.

The individual variables can have signs. In the case of direction x, the direction to the right with respect to current flow direction in a row of electrolytic cells has a positive sign; in the case of direction y, the current flow direction has a positive sign; and in the case of direction z, the upward direction has a positive sign.

The influence of the electromagnetic force can be reduced in the following manner: the electromagnetic forces (FxM and FyM) in directions x and y as the main causes for generating circulation flow in molten aluminum layer are made symmetrical with respect to the axis of direction y passing through the center of each electrolytic cell (the axis will be hereinafter referred to as axis y) and to the axis of direction x passing through the center of each electrolytic cell (the axis will be hereinafter referred to as axis x), respectively, forming composite electromagnetic forces directed to the center of the electrolytic cell, and their absolute values are made smaller.

As is obvious from the equations (1) and (2), these can be attained by satisfying the following conditions.

(1) In the magnetic field in the horizontal direction, the magnetic flux densities in the direction x (Bx) are made reversed in direction and equal in intensity to one another with respect to the axis x and same in direction and equal in intensity to one another with respect to the axis y, and this will be hereinafter referred to as "Bx's being symmetrical to one another with respect to the axes x and y". Their absolute values are also made smaller. On the other hand, the magnetic flux densities (By) in the direction y are made reversed in direction and equal in intensity to one another with respect to the axis y, and same in direction and equal in intensity to one another with respect to the axis x. This will be hereinafter referred to as "By's being symmetrical to one another with respect to the axes x and y". Their absolute values are also made smaller.

(2) The magnetic flux densities in the direction z (Bz) are made reversed in direction and equal in intensity to one another with respect to the axes x and y. This will be hereinafter referred to as "Bz's being symmetrical to one another with respect to the axes x and y". Their absolute values are also made smaller.

(3) The current densities in the directions x and y (DxM and DyM) in molten aluminum layer are made as small as possible.

The foregoing condition (3) is very susceptible to factors other than the bus bar arrangement, for example, the area lined with calcined carbon blocks and carbonaceous stamping mass as members for an electrolytic cell, that is, the area of the so called cathode structure, and thus will be omitted from the following discussion. However, since occurrence of the circulation flow phenomena of molten aluminum can be made considerably less in the present electrolytic cells, the said condition (3) for the bus bar arrangement can be also satisfied in the present invention.

In electrolytic cells in the ordinary side-by-side arrangement, rising bus bars are provided only at the short ends of the cells, and an electric current is supplied to the rising bus bars through cathode bus bars provided in parallel to the short ends and along the outside of the cells. In such an arrangement, the magnetic flux densities in the direction z (Bz) become less symmetrical with respect to axes x and y, mainly because, among composite magnetic flux densities developed by the bus bars arranged in parallel to the axis y, the magnetic flux densities in the direction z (which will be hereinafter referred to as "Bz(Y)") fail to be symmetrical with respect to the axis x. This is because the direction of the electric current passing through these bus bars is on the positive side in the direction y. Thus, the said condition (2) must be satisfied by making Bz(Y) as small as possible in the molten aluminum layer.

It is also known that the rising bus bars are provided only at the short ends of the cells, and a portion or all of the cathode current on the upstream side of each cell is passed through the space below the cell (Japanese Patent Publications Nos. 39445/72, 16843/77 and 10190/82), but in such an arrangement among the magnetic flux densities (Bx and By) in the horizontal direction, the magnetic flux densities in the direction x (Bx) become less symmetrical with respect to the axes x and y, mainly because, among the composite magnetic flux densities developed by bus bars arranged in parallel to the axis y, the magnetic flux densities in the direction x (which will be hereinafter referred to as "Bx(Y)") fail to become symmetrical with respect to the axes x and y. Thus, the said condition (1) must be satisfied by making Bx(Y) as small as possible in the molten aluminum layer.

Furthermore, it is known to provide the rising bus bars on the long sides of cells and pass a portion of cathode current on the upstream side of each cell through the space below the cell (U.S. Pat. No. 3,415,724), but in such an arrangement, among the magnetic flux densities (Bx and By) in the horizontal direction, the magnetic flux densities in the direction x become less symmetrical with respect to the axes x and y, mainly because the current passing through the bus bars arranged in parallel to the axis y is limited to some extent. That is, once the current passing through the individual bus bars is set, the magnetic flux densities developed by the electric current will be also set, and thus the magnetic flux densities in the direction x (Bx(Y)) are also set among the composite magnetic flux densities developed by the bus bars arranged in parallel to the axis y, and it is hard to make them symmetrical with respect to the axes x and y. Thus, even such an arrangement is hard to satisfy the said condition (1).

Furthermore, Japanese Patent Publication No. 3751/82 discloses an arrangement in which the anode bus bars provided above each electrolytic cell and in parallel to the long side of the cell are divided into two groups, i.e. upstream side group and downstream side group, where the electric current from the upstream side of an electrolytic cell provided on the upstream side is supplied to the anode bus bars of the upstream side group simultaneously through rising bus bars provided on the long sides and short ends of the cell, and the electric current from the downstream side of an adjacent electrolytic cell provided on the upstream side is supplied to the anode bus bars of the downstream side group only through rising bus bars provided at the long sides of the cell. In the said arrangement, all the cathode bus bars from the upstream side to rising bus bars provided at the long sides of an electrolytic cell on the downstream side are extended through the space below the cell, and all the cathode bus bars from the upstream side to rising bus bars provided at the short ends of an electrolytic cell on the downstream side are extended along the outsides of the cell.

With this arrangement, the influence of electromgnetic forces can be considerably reduced, as compared with the ordinary bus bar arrangement so far employed, but the present inventors have found by calculation that, among the composite magnetic flux densities developed by bus bars arranged in parallel to the axis y, the magnetic flux densities in the direction z (Bz(Y)) cannot be made much smaller. Furthermore, in this arrangement, it is very difficult to bypass the electric current in the case of shut-down of electrolytic cells, an indispensable operation in the aluminum electrolysis plant. That is, in shutting down an electrolytic cell of bus bar arrangement disclosed in Japanese Patent Publication No. 3751/82, the electric current passing from the downstream side of an electrolytic cell provided on the upstream side to rising bus bars provided on the upstream long side of an electrolytic cell to be shut down must be supplied to rising bus bars provided on the long side of an adjacent electrolytic cell provided on the downstream side without supplying it to the anode bus bars of the electrolytic cell to be shut down. More specifically, when electrolytic cell 14 provided on the downstream side is to be shut down in FIG. 3 of the said publication, the electric current passing to the center rising bus bars 27 and 28 must be supplied to rising bus bars 27 and 28 of the adjacent electrolytic cell provided on the downstream side without supplying it to anode bus bars 22 of the electrolytic cell 14. To this end, considerably long bus bars are required for the short circuit.

An object of the present invention is to provide an electrolytic cell with such an appropriate arrangement of cathode bus bars and anode bus bars as to satisfy the said conditions (1) and (2) simultaneously, thereby remarkably suppressing occurrence of circulation flow phenomena of molten aluminum and considerably improving the current efficiency.

Another object of the present invention is to provide an electrolytic cell which can be shut down with much ease while satisfying the said conditions (1) and (2).

That is, the present invention provides an electrolytic cell, which satisfies the said conditions (1) and (2) at the same time and thereby considerably suppresses the occurrence of circulation flow phenomena of molten aluminum according to such a bus bar arrangement that a number of cathode bus bars on the upstream side of each electrolytic cell is passed through the space below the relevant cell, and connected to rising bus bars provided on the upstream long side of an adjacent electrolytic cell provided on the downstream side to supply an electric current to the anode bus bars of the adjacent electrolytic cell. The remaining number of the cathode bus bars on the upstream long side are extended along the outside at the short ends of the relevant electrolytic cell and connected to rising bus bars provided at the short ends of the adjacent cell provided on the downstream side to supply an electric current to the anode bus bars of the adjacent electrolytic cell. Some portion of the cathode current collected on the downstream side of the relevant electrolytic cell is passed to rising bus bars provided on the upstream long side of the adjacent cell provided on the downstream side to supply an electric current to the anode bus bars of the adjacent electrolytic cell, and the remaining portion of cathode current collected on the downstream side is passed to rising bus bars provided at the short ends of the adjacent electrolytic cell provided on the downstream side along the outside at the short ends of the adjacent electrolytic cell provided on the downstream side to supply an electric current to the anode bus bars of the adjacent electrolytic cell.

BRIEF DESCRIPTION OF THE DRAWINGS

The present invention will be described in detail, referring to the drawings.

In FIG. 1 a basic bus bar arrangement of two adjacent electrolytic cells according to the present invention is shown, where numerals 1*a* and 1*b* are individual electrolytic cells in a row of electrolytic cells, and may be hereinafter referred to merely as "1", where it is not necessary to especially discriminate the individual cells from each other. Arrow mark A shows the overall current direction. The axes x and y are a center line in the long side direction of electrolytic cells and a center line in the short end direction thereof, respectively. In other words, the axis y is an axial line of a row of electrolytic cells.

Figure 1:
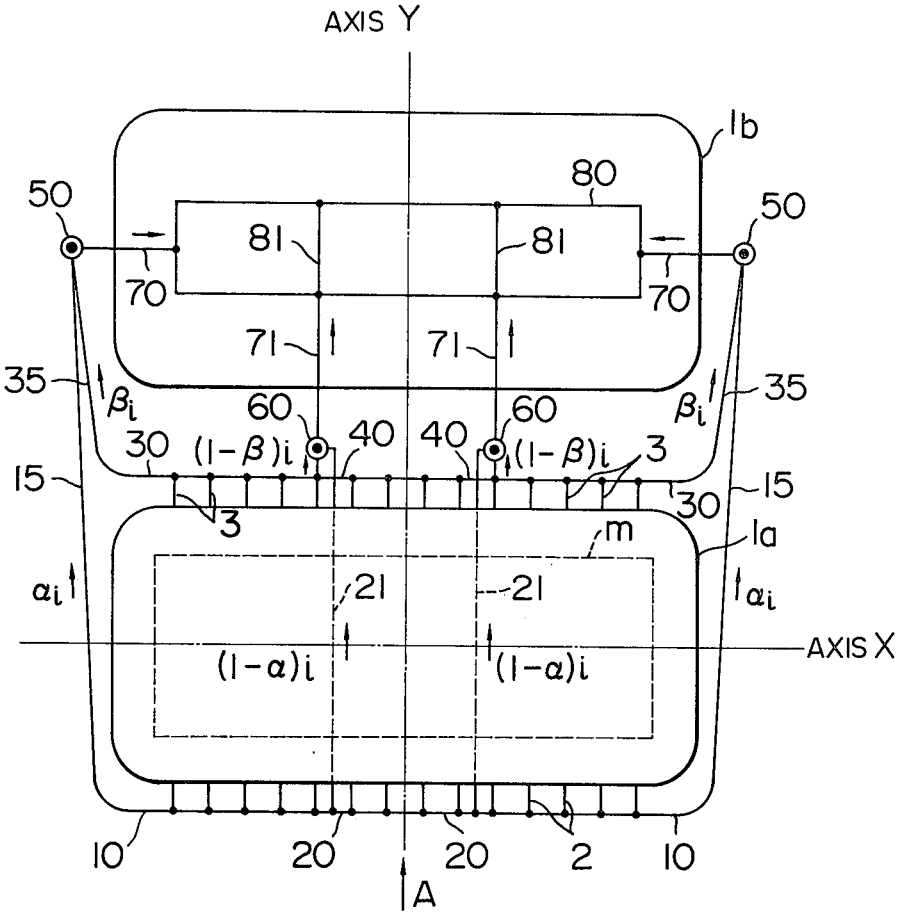
FIG. 1 is a schematic plan view of a bus bar arrangement according to the present invention.

Cathode current collector bars 2, 2 . . . and 3, 3 . . . are projected from the cathodes of electrolytic cell 1*a* towards the upstream side and the downstream side respectively, and are connected to cathode bus bars 10 and 20, and 30 and 40, respectively. A portion, preferably 20–70%, of cathode current collected on the upstream side (which corresponds to one-half of the total current) is passed through at least one cathode bus bar 21 provided in the space below the electrolytic cell 1*a* and in parallel to the axial line (axis y) of a row of electrolytic cells. The cathode bus bar 21 is connected to at least one rising bus bar 60 provided on the upstream long side of electrolytic cell 1*b* provided on the downstream side. The remaining portion of the cathode current collected on the upstream side, that is, preferably 30–80% of the cathode current, is led to rising bus bars 50 provided at the outsides at the short ends of electrolytic cell 1*b* through cathode bus bars 15 extending along the outsides at the short ends of the electrolytic cell 1*a* to the outsides at the short ends of the electrolytic cell 1*b*.

On the other hand, a portion, preferably 40–90%, of cathode current collected on the downstream side (which corresponds to one-half of the total current) is led to rising bus bars 60 provided on the upstream long side of electrolytic cell 1*b* provided on the downstream side. The remaining portion, that is, preferably 10–60%, of the cathode current collected on the downstream side is passed through cathode bus bars 35 extending along the outsides at the short ends of the cell 1*b* provided on the downstream side to rising bus bars 50 provided at the outsides at the short ends of the cell 1*b*.

The current collected at the rising bus bars 50 at the short ends of the cell 1*b* is supplied to anode bus bars 80 through anode bus bars 70 from the rising bus bars 50. The current collected at the rising bus bars 60 on the long side of the cell 1*b* is supplied to anode bus bars 80 from the rising bus bars 60 through anode bus bars 71 and 81 in parallel to the axis y. These cathode bus bars, rising bus bars, and anode bus bars need not be unitary structures but can be further divided.

As already mentioned above. Bz(Y) must be made as small as possible in the molten aluminum layer to satisfy the said condition (2). To this end, a portion of the cathode current collected on the upstream side is made to pass through cathode bus bars 21 provided in the space below each electrolytic cell and the cathode bus bars 21 are connected to rising bus bars 60 provided on the long side of the cell 1*b* in the present invention. Furthermore, a portion of cathode current collected on the downstream side is likewise supplied to rising bus bars 60 on the long side of 1*b*. That is, proper allocation of the electric currents to the cathode bus bars 15, 35 and 21 and anode bus bars 71 and 81 can minimize the magnetic flux densities in the direction z (Bz(Y)) to be developed in the molten aluminum layer, amond the composite magnetic flux densities to be developed by these electric currents. In other words, it is essential for proper allocation of these electric currents to provide cathode bus bars 15 and 35 extending to rising bus bars 50 at the short ends of the adjacent cell along the outsides at the short ends and provide cathode bus bars 2 in the space below each cell and connect them to rising bus bars 60 on the long side of the adjacent cell and also to connect some number of cathode bus bars 40 on the downstream side of the cell to the rising bus bars 60 on the long side of the adjacent cell.

It is also necessary in the present invention to minimize the magnetic flux densities in the direction x (Bx), particularly Bx (Y), to be developed in the molten aluminum layer, among the magnetic flux densities in the horizontal direction (Bx and By) to satisfy the said condition (1). To this end, rising bus bars 50 and 60 are provided at both the short ends and on the long side of each cell in the present invention. That is, proper allocation of electric currents to groups of bus bars provided in parallel to the axis y, for example, cathode bus bars 15, 35 and 21 and anode bus bars 71 and 81 in FIG. 1 can also minimize the magnetic flux densities in the direction x (Bx(Y)) among the composite magnetic flux densities to be developed by these electric currents in the same manner as the said condition (2) has been satisfied above. Thus, it is necessary in the present invention to properly allocate the electric currents to groups of bus bars 15, 35, 21, 71 and 81 in parallel to the axis y to satisfy the said conditions (1) and (2) at the same time.

Among the magnetic flux densities (Bx and By) in the horizontal direction, the magnetic flux densities in the direction y (By) can be made symmetrical with ease even in the well known electrolytic cells, but in the present invention rising bus bars 60 are provided on the long side of each cell to reduce the magnetic flux densities to be developed by the anode bus bars 70 and 80, thereby making its absolute values as small as possible.

The foregoing explanation can be illustrated below by symbols by way of simple formulae. Suppose total electric current for electrolysis be designated by I. Electric currents collected on the upstream side and the downstream side will be I/2 each. In one half of the electric current (I/2) collected on the upstream side, that is, I/4, suppose the ratio of the electric current passing through the cathode bus bars 15 extending along the outsides at the short end of the cell is "$\alpha$". Also in one half of the electric current (I/2) collected on the downstream side, that is, I/4, suppose the ratio of the electric current passing through the cathode bus bars 35 extending along the outsides at the short ends of the cell is "$\beta$", and suppose the sum total of electric currents passing through the cathode bus bars 21 provided in the space below the cell be "Iu".

$$Iu=2(1-\alpha)\times I/4$$

Suppose the sum total of electric currents passing to the rising bus bars 50 is $I_{R1}$.

$$I_{R1}=2(\alpha+\beta)\times I/4$$

Suppose the sum total of electric currents passing to the rising bus bars 60 is $I_{R2}$.

$$I_{R2}=2(2-\alpha-\beta)\times I/4$$

In FIG. 1, ratios of electric currents passing through the individual bus bars are shown, presuming i=I/4.

The values $\alpha$ and $\beta$ can be set as follows:

Among the magnetic flux densities to be developed by electric currents passing through all the cathode bus bars 15, 21 and 35 and all the anode bus bars 71 and 81 in parallel to the axis y, at first the magnetic flux densities in the direction z (Bz) must be minimized in the molten aluminum layer m in electrolytic cell 1 as condition 1. Secondly, the magnetic flux densities in the direction x (Bx) must be minimized in the molten aluminum layer m. Once the positions of the cathode bus bars and the anode bus bars in parallel to the axis y are set, the values $\alpha$ and $\beta$ satisfying the said conditions 1 and 2 will be set.

The present inventors have found by calculation that when the positions of cathode bus bars and anode bus bars are selected from the ordinary economical viewpoint, $\alpha$ and $\beta$ fall within the following ranges:

$$\alpha=0.3\text{–}0.8$$
$$\beta=0.1\text{–}0.6$$

When $\alpha$ is below 0.3 or above 0.8, the magnetic flux densities in the direction z (Bz(Y)) will be not always reduced in the molten aluminum layer among the composite magnetic flux densities to be developed by the bus bars provided in parallel with the axis y, and thus the said condition (2) will be less satisfied. On the other hand, when $\beta$ is above 0.6, the magnetic flux densities in the direction x (Bx(Y)) will be not always reduced in the molten aluminum layer among the composite magnetic flux densities to be developed by the bus bars provided in parallel to the axis y, and thus the said condition (1) will be less satisfied. When $\beta$ is below 0.1, said Bz(Y) will not be so much reduced.

In the foregoing, description has been made of the case that the bus bars of electrolytic cell 1 are arranged symmetrically with respect to the axis y, that is, the case that no influence of magnetic field due to the electric currents passing through an adjacent row of electrolytic cells is taken into account. The ordinary electrolysis plant has an adjacent row of electrolytic cells on an electrical ground. If the distance to the adjacent row of electrolytic cells (center-to-center distance) is relatively long, or if some measures are taken for appropriate compensation for the influence of the adjacent row, the bus bars can be arranged substantially symmetrically with respect to the axis y, as described above, but if the distance to the adjacent row (center-to-center distance) is relatively short, the cathode bus bars 21 passing through the space below the cell can be positioned asymmetrical with respect to the axis y or the ratio of electric current passing through the cathode bus bars 10 and 15 extending along the outsides at the short ends of cell can be changed between the left outside and right outside among the upstream cathode currents. It is of course possible to use these two measures in combination.

Furthermore, independently from or together with one or two of these measures, the ratio of electric current passing through the cathode bus bars 30 and 35 extending along the outsides at the short ends of the adjacent electrolytic cell provided on the downstream side can be varied between the left outside and the right outside.

In the present invention, appropriate allocation of electric currents to the individual bus bars can cause components of the magnetic flux densities in the directions x and y (Bx and By) to be developed in the molten aluminum layer symmetrical with respect to the axes x and y and also can make their absolute values smaller, and further can make the magnetic flux densities in the direction z (Bz) symmetrical with respect to the axes x and y and also make its absolute values smaller, as described above. Thus, the present invention provides a bus bar arrangement most suitable for effectively suppressing occurrence of circulating flow phenomena in the molten aluminum layer.

In electrolytic cells having a bus bar arrangement according to the present invention, shut-down of electrolytic cells, which is an indispensable operation in the aluminum electrolysis plant, can be carried out with ease. To this end, short-circuit conductors are provided at the rising bus bars 50 to pass the electric currents collected at rising bus bars 50 to the cathode bus bars 15 of an adjacent electrolytic cell provided on the downstream side, and also short-circuit conductors are provided at the rising bus bars 60 to pass the electric current collected at the rising bus bars 60 to the cathode bus bars 21 provided in the space below an adjacent electrolytic cell on the downstream side.

Figure 2:
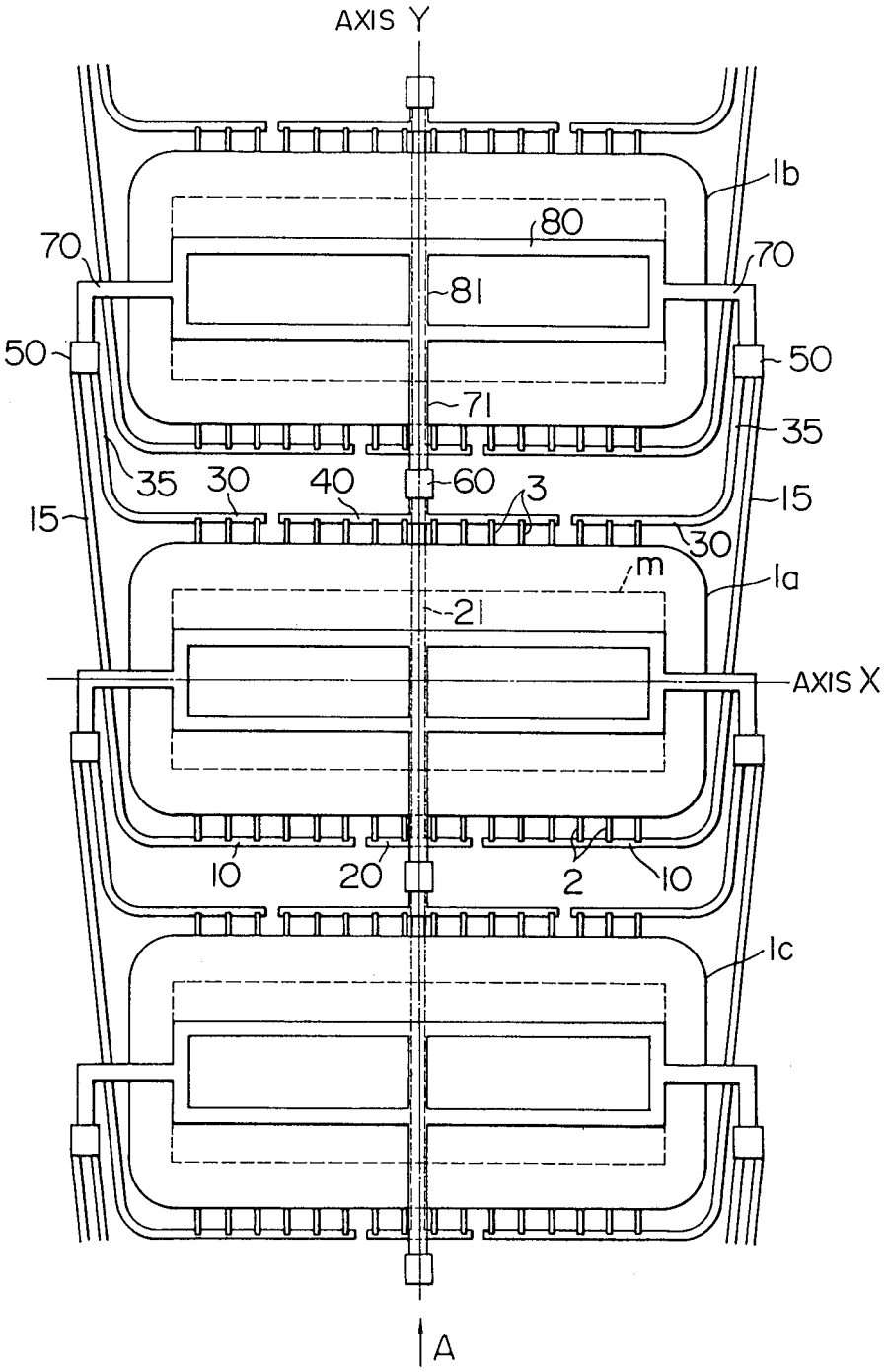
FIGS. 2–4 are schematic plan views of specific embodiments according to the present invention.
Figure 3:
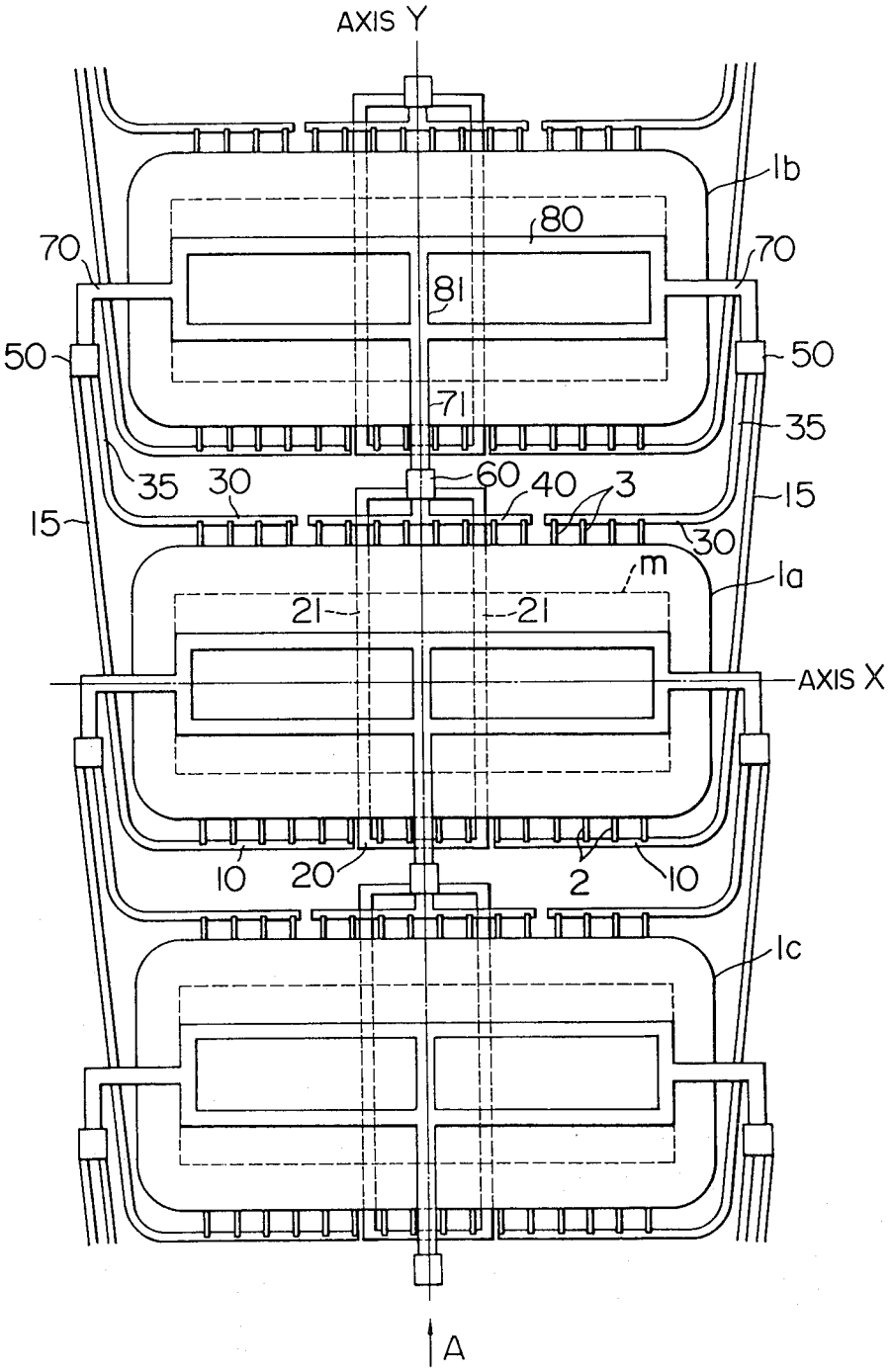
Figure 4:
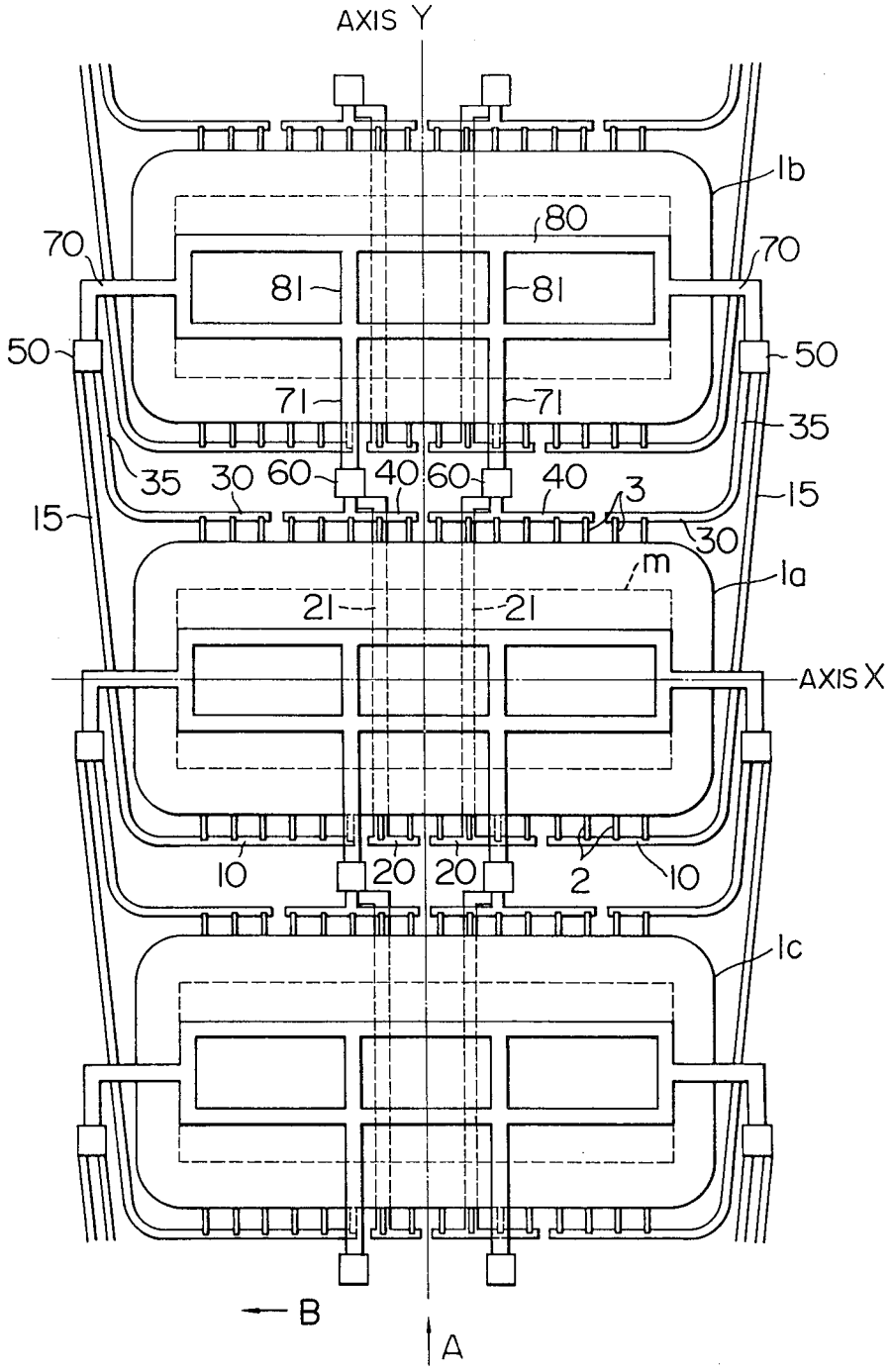

In FIGS. 2 to 4, specific embodiments of the present invention are shown, where the same members as in FIG. 1 are identified with the same numerals, and electrolytic cells 1*a*, 1*b* and 1*c* will be hereinafter referred to merely as "1", unless it is especially necessary to discriminate them from one another.

In FIG. 2, cathode current collector bars 2 and 3 are projected from the upstream side and downstream side of electrolytic cell 1, respectively, and connected to cathode bus bars 10 and 20 on the upstream side and cathode bus bars 30 and 40 on the downstream side, respectively. The ratio $\alpha$ of electric current passing through the cathode bus bars 10 and 15 extending along the outsides at the short end of the cell to the total cathode currents on the upstream side is given below.

$$\alpha=0.75\ (75\%)$$

The ratio $\beta$ of electric current passing through the cathode bus bars 30 and 35 extending along the outsides at the short ends of an adjacent electrolytic cell provided on the downstream side to the total cathode currents on the downstream side is given below:

$$\beta=0.375\ (37.5\%)$$

Cathode bus bar 21 provided in the space below the cell and along the axis y is connected to rising bus bar 60. Cathode bus bar 40 on the downstream side is also connected to the rising bus bar 60.

On the other hand, the cathode bus bars 15 and 35 are connected to rising bus bars 50 provided at the short ends of an adjacent electrolytic cell provided on the downstream side. The rising bus bars 50 and 60 are further connected to an anode bus bar 80 through anode bus bars 70 and 71, respectively. The anode bus bar 80 is provided with another anode bus bar 81 along the axis y.

In FIG. 3, cathode current collector bars 2 and 3 are projected from the upstream side and downstream side of electrolytic cell 1, and are connected to cathode bus bars 10 and 20 on the upstream side and cathode bus bars 30 and 40 on the downstream side. The ratio $\alpha$ of electric current passing through the cathode bus bars 10 and 15 extending along the outsides at the short end of the cell to the total cathode currents on the upstream side is given below:

$$\alpha=0.75\ (75\%)$$

The ratio $\beta$ of electric current passing through the cathode bus bars 30 and 35 extending along the outsides at the short ends of an adjacent electrolytic cell provided on the downstream side to the total cathode currents on the downstream side is given below:

$$\beta=0.50\ (50\%)$$

The cathode bus bar 21 is divided into two parts which are provided in the space below the cell and in parallel to the axis y, and through which 50% each of electric current is passed. The cathode bus bars 21 are connected to a rising bus bar 60 provided at the center on the long side between a cell and the adjacent cell. The cathode bus bar 40 on the downstream side is also connected to the rising bus bar 60. On the other hand, the cathode bus bars 15 and 35 are connected to rising bus bars 50 provided at the short ends of an adjacent cell provided on the downstream side. The rising bus bars 50 and 60 are further connected to anode bus bars 80 through anode bus bars 70 and 71. The anode bus bars 80 are provided with another anode bus bar 81 along the axis y.

FIG. 4 shows an embodiment in which an adjacent row of electrolytic cells is at a relatively short distance, and the direction of the adjacent row is given by arrow mark B.

Cathode current collector bars 2 and 3 are projected from the upstream side and downstream side of electrolytic cell 1, and are connected to cathode bus bars 10 and 20 on the upstream side and cathode bus bars 30 and 40 on the downstream side. On the side near the adjacent row, ratios $\alpha$ and $\beta$, as defined before, are given below:

$$\alpha=0.750\ (75.0\%)$$

$$\beta=0.375\ (37.5\%)$$

On the other hand, on the side remote from the adjacent row, the ratios $\alpha$ and $\beta$ are given below:

$$\alpha=0.500\ (50.0\%)$$

$$\beta=0.250\ (25.0\%)$$

Cathode bus bar 21 is divided into two parts and provided in the space below the cell. The cathode bus bars 21 are connected to rising bus bars 60, respectively, provided at two positions on the long side between an electrolytic cell and the adjacent cell. Cathode bus bars 40 on the downstream side are also connected to rising bus bars 60, respectively.

On the other hand, cathode bus bars 15 and 35 are connected to rising bus bars 50 provided at the short ends of an adjacent electrolytic cell provided on the downstream side.

The rising bus bars 50 and 60 are further connected to anode bus bars 80 through anode bus bars 70 and 71.

Two anode bus bars 71 are provided to meet the number of the rising bus bars 60, and two anode bus bars 81 are provided in parallel to the axis y between the anode bus bars 80 to meet the number of rising bus bars 60.

The cathode bus bars 21, rising bus bars 50 and 60 and anode bus bars 71 and 81 are provided symmetrically to the left side and the right side with respect to the axis y.

As described above, electrolytic cells with a bus bar arrangement according to the present invention can suppress occurrence of circulating flow phenomena in molten aluminum layer in electrolytic cells, and can improve the current efficiency. Thus, the present invention can provide electrolytic cells with a larger capacity, which can be operable with good stability and efficiency even against the larger capacity.

What is claimed is:

1. Apparatus for producing aluminum, comprising a plurality of rectangular, electrolytic cells, disposed in at least one row of a side-by-side arrangement of cells, each of said cells comprising:

two long sides which are upstream and downstream with respect to current flow along the row;

two short ends which are substantially parallel to the current flow along the row;

a first plurality of cathode bus bars connected to cathode current collector bus bars extending from the upstream long side of the cell, a first portion of said first plurality of bus bars being connected to at least one rising bus bar located at the upstream long side of a second, downstream adjacent cell through at least one cathode bus bar provided below said cell and parallel to the length of the row of cells;

a second portion, which is the remaining portion of said first plurality of bus bars, connected to rising bus bars provided at the short ends of the second, downstream adjacent cell through cathode bus bars extending along the outsides of the short ends of the cell;

a second plurality of cathode bus bars connected to cathode current collectors extending from the downstream long side of said cell, a first portion of said second plurality of bus bars being connected to at least one rising bus bar located on the upstream long side of the second, downstream adjacent cell; and a second portion, which is the remaining portion of said second plurality of bus bars, connected to rising bus bars provided at the short ends of the second, downstream adjacent cell through cathode bus bars extending along the outsides of the short ends of the adjacent cell.

2. The apparatus according to claim 1, wherein 30–80% of electric current collected at the cathode bus bars on the upstream side of the electrolytic cell is passed through the cathode bus bars extending along the outside of the short ends of the electrolytic cell.

3. The apparatus according to claim 2, wherein 10–60% of the electric current collected at the cathode bus bars on the downstream side of each electrolytic cell is passed through the cathode bus bars extending along the outsides of the short ends of the downstream adjacent electrolytic cell.

4. The apparatus according to claim 1, wherein 10–60% of the electric current collected at the cathode bus bars on the downstream side of the electrolytic cell is passed through the cathode bus bars extending along the outsides of the short ends of the downstream adjacent electrolytic cell.

5. The apparatus of claim 1, further comprising anode bus bars connected to the rising bus bars.

* * * * *